United States Patent [19]

Giani et al.

[11] 4,238,999

[45] Dec. 16, 1980

[54] ROTARY CYLINDRICAL SCREEN PRINTING APPARATUS FOR SPECULARLY PRINTING EQUAL PATTERNS AND/OR COLORS ONTO THE OPPOSITE FACES OF FABRICS OR THE LIKE

[75] Inventors: Adolfo Giani, Bergamo; Mario Panseri, Ranica; Umberto Mascioni, Azzio, all of Italy

[73] Assignee: Reggiani Macchine S.p.A., Bergano, Italy

[21] Appl. No.: 957,841

[22] Filed: Nov. 6, 1978

[30] Foreign Application Priority Data

Nov. 7, 1977 [IT] Italy ..... 29402 A77

[51] Int. Cl.[3] ..... B41F 15/12

[52] U.S. Cl. ..... 101/116; 101/124; 101/118; 101/180; 101/221; 101/224

[58] Field of Search ..... 101/114, 115, 116, 118, 101/121, 122, 124, 126, 180, 181, 220, 221, 224, 179

[56] References Cited

U.S. PATENT DOCUMENTS

| | | | |
|---|---|---|---|
| 3,040,657 | 6/1962 | Ichinose | 101/115 |
| 3,165,056 | 1/1965 | Heatley, Jr. et al. | 101/181 |
| 3,280,737 | 10/1966 | Huck | 101/180 |
| 3,398,680 | 8/1968 | Moskowitz | 101/115 |
| 3,474,311 | 10/1969 | Lewis, Jr. | 101/181 |
| 3,601,587 | 8/1971 | Thiede | 101/181 |
| 3,852,980 | 12/1974 | Zimmer | 101/118 |
| 3,915,090 | 10/1975 | Horst et al. | 101/181 |
| 3,934,505 | 1/1976 | Kushner | 101/181 |
| 4,103,615 | 8/1978 | Cruz et al. | 101/115 |

*Primary Examiner*—William Pieprz

*Attorney, Agent, or Firm*—Stevens, Davis, Miller & Mosher

[57] ABSTRACT

A rotary cylindrical-screen printing apparatus for specularly printing equal patterns and/or colors onto the opposite faces of a fabric is disclosed, comprising two rotary screen printing machines, each equipped with electromechanical means for synchronizing the speed of the belt with the speed of the printing rollers, in which said machines are coupled by arranging one machine over the other, the fabric entering the underlying machine and thereafter entering the second upper machine which prints the opposite face of the fabric, the second machine comprising a transmission roller associated with its belt having a diameter equal to at least twice the diameter of the contiguous roller of the first machine, the apparatus comprising means for synchronizing the speeds of the printing rollers of two machines, including a transducer linked to the speed of the belt of a machine, whose outgoing frequency signal is sent to pilot the electrohydraulic motors controlling the printing rollers of both machines and means for synchronizing the speeds and phase of the two belts by linking the speed of the belt of one machine with the speed of the other belt through digital-analogue converters effecting a comparison between frequency signals picked up proportionally to the speeds of the two belts so as to emit a signal for the correction of speed and phase, said signal being sent to a means for driving the belt of the controlled machine.

6 Claims, 5 Drawing Figures

ROTARY CYLINDRICAL SCREEN PRINTING APPARATUS FOR SPECULARLY PRINTING EQUAL PATTERNS AND/OR COLORS ONTO THE OPPOSITE FACES OF FABRICS OR THE LIKE

This invention relates to a printing apparatus of the type equipped with revolving rollers (rotary printing screens), which is particularly useful for continuously printing onto the two opposite faces of a fabric or the like patterns and/or colors equal to each other and perfectly opposed, or also patterns and/or colors different from each other.

At present the specular printing of equal and opposed patterns onto the opposite faces of a fabric, as well as the printing of different patterns, is generally carried out in vertical machines equipped with opposed printing rollers rotating around horizontal axes parallel to each other, the fabric to be printed being made to pass between such rollers. Since these types of machines are not equipped with a carrying belt for carrying the fabric, they have in practice a low degree of accuracy (repeat errors), since the fabric, due to the fact that it is not carried, tends to shrink when impregnated with color. Furthermore, such machines do not enable one satisfactorily to print light fabrics or fabrics of considerable width.

The printing on both faces of a fabric may also be effected by means of conventional machines equipped with rotary screens in contact with an endless carrying belt. In order to obtain this type of print, however, it is necessary to carry out two separate and consecutive printing cycles utilizing either the same machine or two different machines.

As a consequence the conventional techniques do not in practice enable one to continuously print an equal and perfectly opposed pattern onto the two opposite faces of a fabric, no matter whether light or heavy, without repeat errors between the patterns.

It is therefore an object of this invention to provide a rotary cylindrical screen printing machine that will enable one to obtain, in only one working step, i.e. in only one passage of the fabric, a perfectly specular print of the same pattern and/or color onto the two opposite faces of a fabric, with the same ratio accuracy and the same limitations, as regards type, weight and width of the fabric, as the conventional multi-color rotary screen machines utilized at present for the continuous printing on only one face of the fabric.

Another object of the present invention is to provide an apparatus suitable not only for the specular printing on both faces of a fabric, but also for use as the usual multi-color printing machine without requiring for such change of purpose any particular devices or complicated setting up operations.

These and other objects are advantageously achieved by a printing apparatus consisting, according to this invention, of two coupled rotary screen printing machines of the type equipped with electromechanical means for synchronizing the belt speed with the speed of the printing rollers, as described in Italian Pat. No. 894,528 of June 22, 1970, according to which the coupling of the two machines is preferably obtained by arranging in parallel one machine upon the other, the inlet of the fabric being to the lower machine, wherein the fabric is printed on one face, while the outlet of the fabric is in the other (upper) machine that carries out the printing from the opposed faces, a transmission roller being arranged on the upper receiving machine, such roller constituting the drawn roller of the upper belt, having a diameter substantially equal to about twice the diameter of the delivery roller of the underlying machine, in order to generate, on said transmission roller, an adhesive force equal to at least the detaching force of the fabric from the delivery roller, thus reducing to the least possible extent the elastic slippage between the belt and fabric, means for synchronizing the speed of the printing rollers of both machines being also provided, including electrohydraulic motors for driving the digital speed control rollers, as well as means for synchronizing the speed of the belts of the two machines by linking the speed of the belt of one machine to the speed of the other belt through digital-analogue converters, which make the comparison between electrical signals picked up proportionally to the speeds of both belts and thereby emit a speed and phase correction signal, which is sent to an electro-hydraulic motor that drives the controlled machine.

More particularly, said transmission roller, capable of detaching the fabric from the delivery belt and of transferring it to the receiving belt, has a diameter preferably greater than twice the diameter of the underlying delivery roller, so as to obtain, for a usual thickness of the receiving belt of about 3 mm, a slippage between belt and fabric lower than 0.003 ($3^{\circ}/_{oo}$), i.e. a slippage acceptable in practice.

A preferred, but not exclusive, embodiment of the present invention will now be described in still greater detail with reference to the attached drawings, which are purely illustrative and not limitative, and wherein.

Figure 1A:
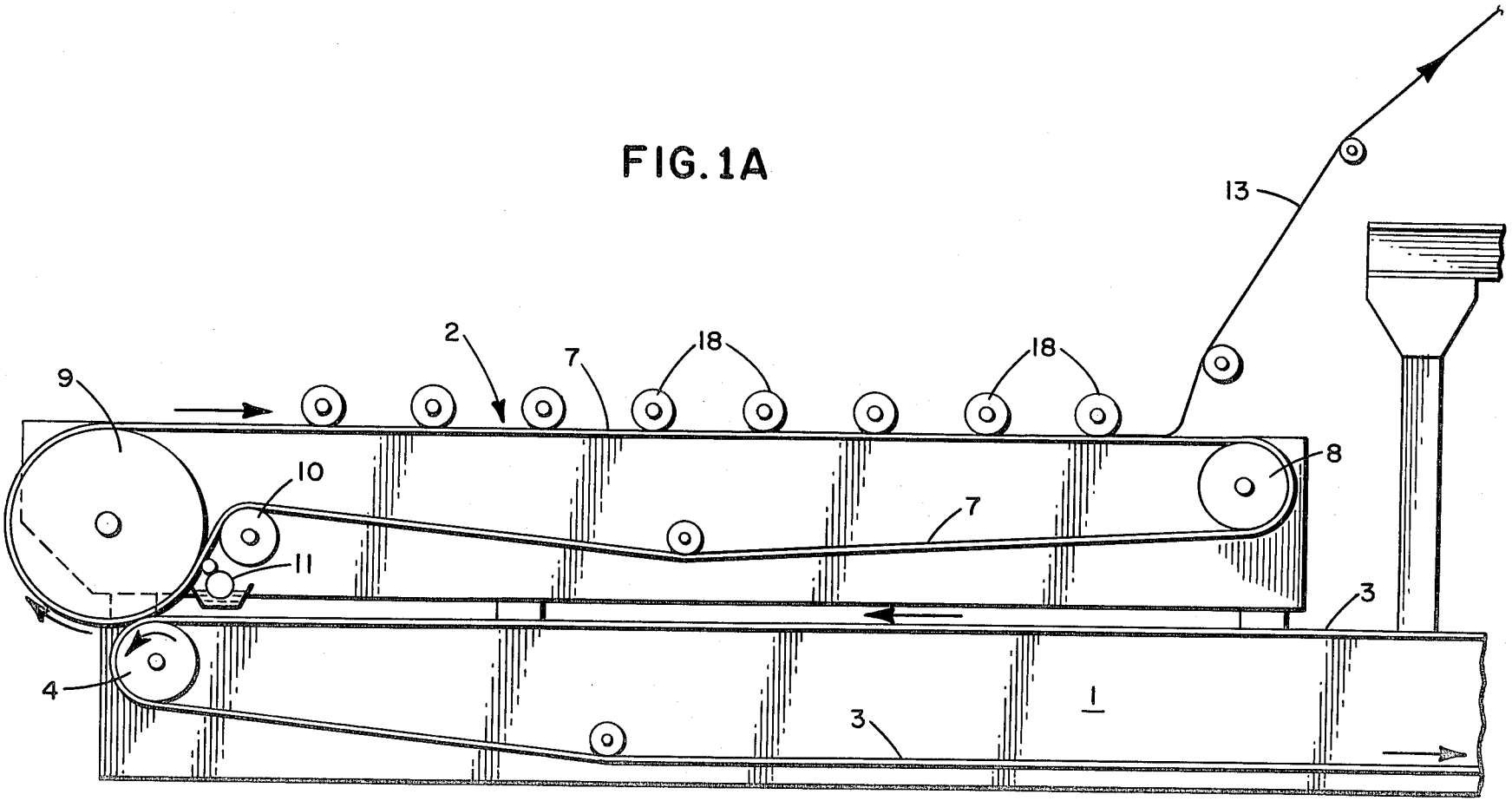
FIGS. 1A and 1B represents schematically a general view of the apparatus consisting of two coupled printing machines, according to this invention.
Figure 1B:
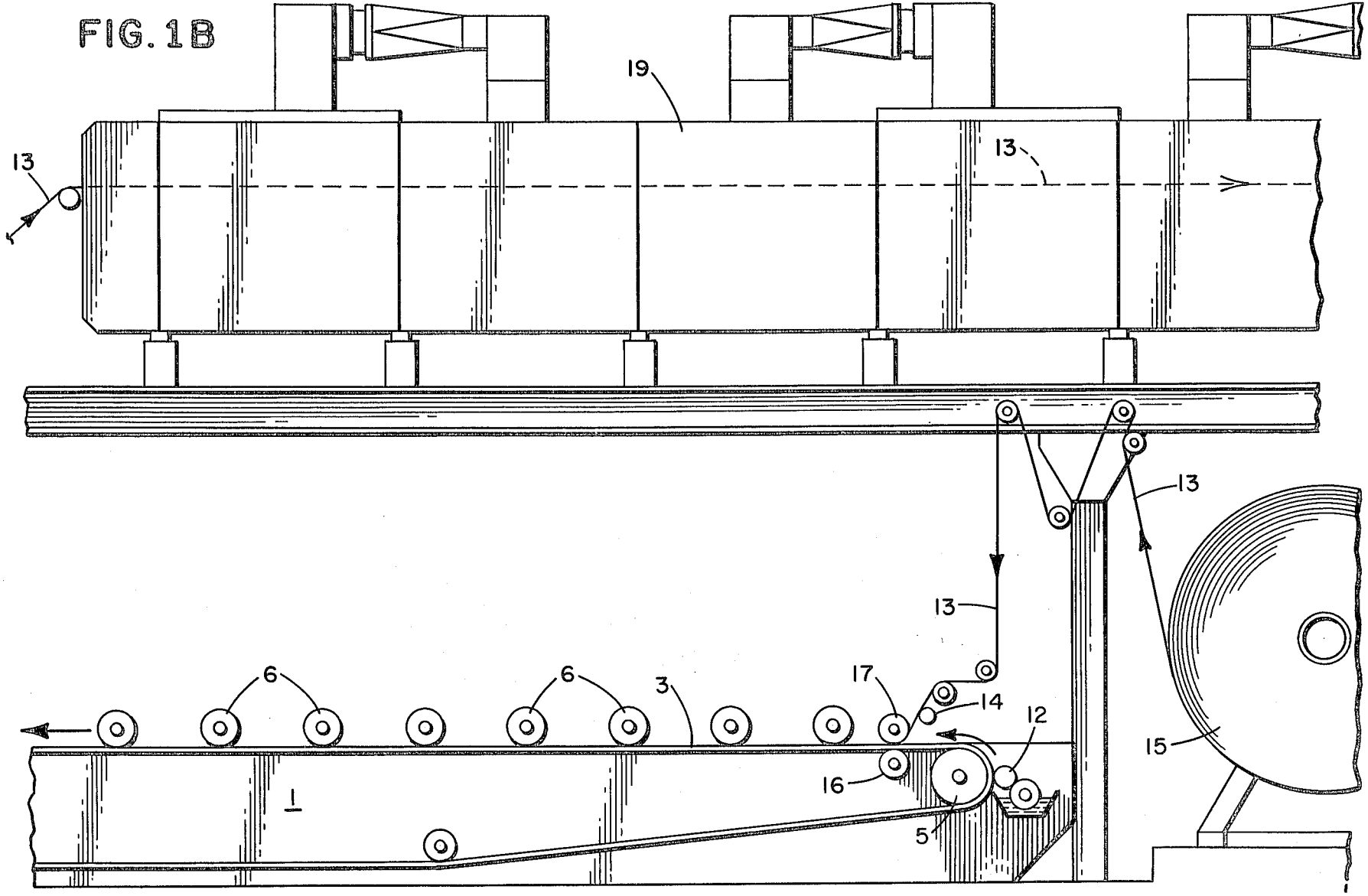

With reference to such figures, and particularly FIGS. 1A and 1B, the printing apparatus forming the object of the present invention consists essentially of two rotary screen printing machines, one of which is arranged over the other.

In particular, the lower machine 1 is longer than the upper machine 2 in order to allow a close positioning of the second machine on the first one, leaving free such portion of belt of the first machine 1 as is sufficient for the arrangement of the necessary printing units. To permit this in practice, in the lower machine 1 the endless belt is stretched between a roller or driving pulley 4 and a transmission roller 5 and its own printing units (rotary rollers) 6 positioned on the portion of a belt 3 which is not occupied by the upper machine 2.

In the upper machine 2, conversely, belt 7 is stretched between a driving roller 8 and a transmission roller 9, the latter having a diameter much greater than that of roller 4 with which it is in contact for reasons which will be explained hereinafter.

A deflection roller 10 is arranged on the lower return run of belt 7, for the purpose of bringing about a marked deflection of belt 7 necessary to create space enough to allow the insertion, between roller 9 and belt 3, of a roller device 11 for spreading adhesive onto belt 7 of the second machine.

A similar adhesive spreading roller device 12 is arranged in contact with transmission roller 5 to permit the initial glueing of fabric 13 to belt 3, according to conventional techniques.

Fabric 13 is fed from the bottom upwards from the reel 15. The fabric 13, coming from the reel 15, is glued with the aid of glue applicator or dispenser 14 to belt 3 (on which adhesive has been already spread by roller device 12) by opposed rollers 16 and 17. Successively the fabric thus glued to the belt passes under the printing units 6, which effect the printing onto the upper face of the fabric. The fabric then moves on until it reaches the zone of contact between rollers 4 and 9, where it is transferred onto the larger roller 9 and where the fabric is glued to the belt 7 of the second machine 2 by means of glue applicator or dispenser 11.

After the transferral of the fabric 13 onto the belt 7 of machine 2, the fabric face opposite the one already printed is now in the correct position for being printed by printing units 18 of machine 2. The fabric 13, after having been thus printed on both faces, enters then a conventional drier 19, wherefrom it emerges ready for being wound on a reel (not shown) in conventional manner.

The rotary screen machines suitable for specularly printing the opposite faces of a fabric may be of the same type as those described in the above-mentioned Italian Pat. No. 894,528, i.e. rotary cylindrical screen machine equipped with a special electro-mechanical system, capable of automatically effecting a perfect synchronization between the rotation of the printing rollers and the translation movement of the belts carrying the fabric. This special synchronizing system consists essentially of a wheel that rests on the belt and feels or senses the forward displacement of same. This wheel is rigidly keyed to an electro-mechanical transducer which generates a series of pulses, the frequency of which is proportional to the belt displacement speed. These pulses are sent to an amplifier-converter which controls a step-by-step motor which, in its turn, controls an hydraulic motor, which motor controls the transmission or movement of the printing rollers, which are all connected with a unique transmission shaft. This special system thus utilizes a rigid kinematic chain between the belt and the printing rollers.

Both machines 1 and 2 of this invention include this special synchronizing system for synchronizing the belt speed with the speed of the rollers.

According to this invention, in order to obtain a specular print of a certain pattern and/or color on the opposite faces of a fabric, i.e. with the print in perfectly opposed positions on the two faces of the fabric, the apparatus is equipped with particular devices which, combined with two printing machines of the type specified hereinbefore, enable one in practice to achieve the objects of the invention.

More in particular, in order to obtain a perfectly specular print it is necessary that the transfer of the fabric from the first machine to the second one should occur with a regular or predetermined detachment of the fabric from the delivery belt and with a regular or predetermined laying down and glueing of said fabric onto the receiving belt. Furthermore it is absolutely necessary to achieve perfect synchronization of the speeds of both belts as well as of the speeds and phase of the printing units of the two machines.

In order to obtain the desired perfect transfer of the fabric, the apparatus according to the present invention comprises a transmission roller 9 (FIG. 1A) for the receiving belt 7 having a diameter much greater than that of the roller 4, preferably equal to about twice the diameter of roller 4 and, more generally, such a diameter as to cause the adhesion force of the fabric to the receiving belt 7 at the moment of detachment to be at least equal to, and preferably greater than the detaching force of the fabric from the belt 3 of the delivery machine 1.

In practice, it has been ascertained that in order to reduce the slippage between fabric and belt (the belt having a usual thickness of about 3 mm) to values lower than 0.003, roller 9 must have a diameter not below 1000 mm and precisely $\geqq 1030$ mm. As the diameter of the deliver roller 4 is generally about 480–500 mm, it follows that the diameter of roller 9 must practically be equal to at least twice the diameter of the delivery roller 4.

Figure 2:
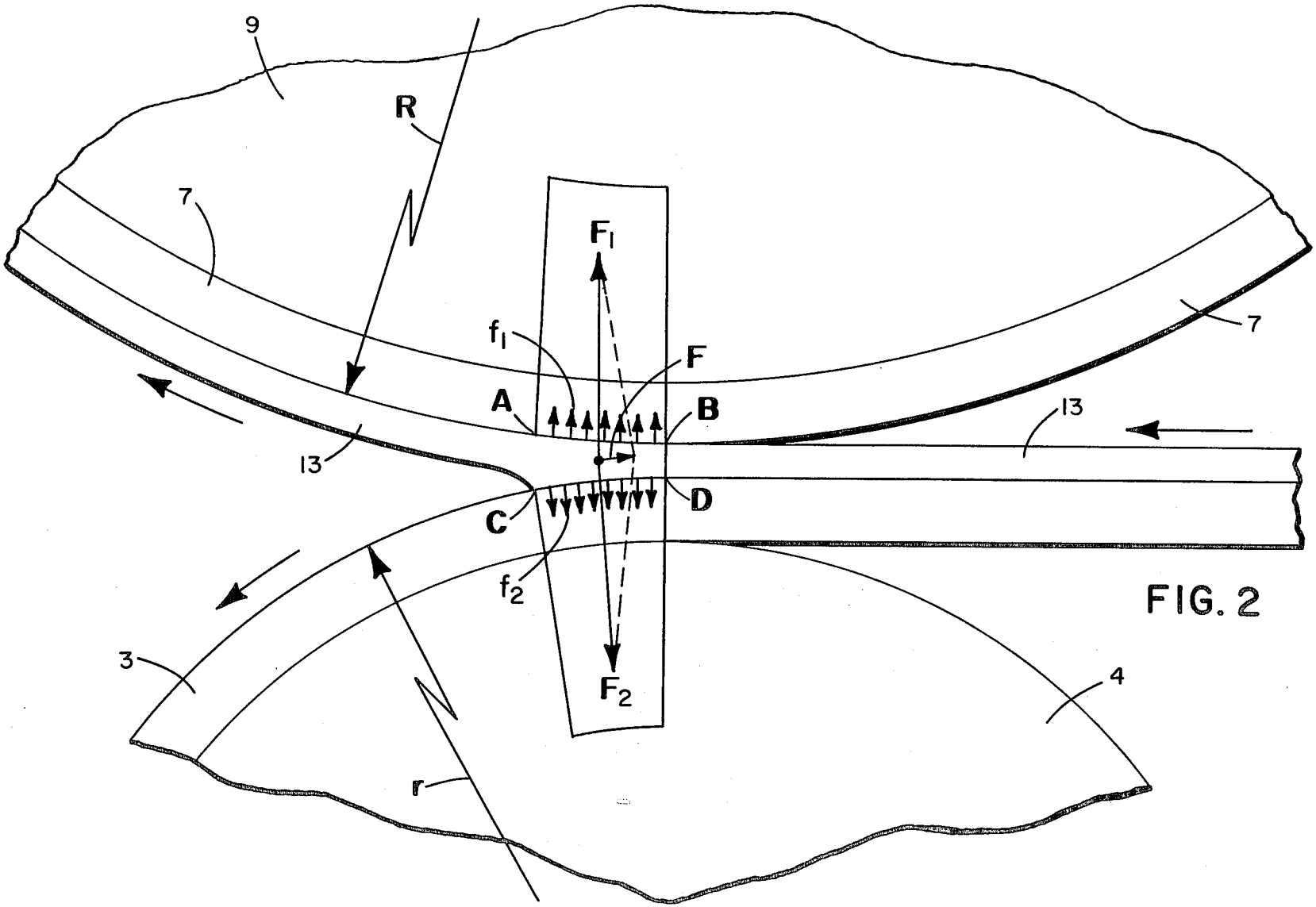
FIG. 2 represents schematically a distribution of the detaching forces acting on the fabric in the zone where the fabric is transferred from the belt of a machine to the belt of the overlying machine.

The schematic drawing of FIG. 2 proves and confirms the necessity of using a roller 9 having a diameter much greater than that of delivery roller 4. In that FIG. 2, R is the radius of the greater roller 9, r is the radius of the smaller roller 4, and 7 and 3 are the corresponding belts respectively.

Assuming that detaching zones A-B on the roller 9 and C-D on the opposite roller 4 are equal to each other (due to their slight extension), then the elemental adhesion forces of fabric 13 with respect to belt 7 of roller 9, indicated by $f_1$ and all directed to the center of the roller 9 having radius R, and, analogously, elemental adhesion forces $f_2$ (which oppose the detachment of the fabric 13 from belt 3) give place to two opposite forces $F_1$ and $F_2$ (directed towards the centers of roller 9 and roller 4 respectively) whose resultant F is angularly shifted towards the greater roller 9 and in the opposite direction to the forward displacement or movement of the fabric, i.e. so as to facilitate the detachment of the fabric 13 from the delivery belt 3 for laying it down onto the receiving belt 7, the intensity of such resultant F being the higher, the greater is the difference between the diameters of the two rollers.

As already explained above, in order to otbtain a satisfactory specular print it is necessary to maintain the "repeat" between the pattern printed on one face of the fabric and the same pattern printed on the reverse side. This result is obtainable by synchronizing the speed and the phase of the printing units of both machines and the speeds of the belts of said machines.

The synchronization of the rollers of the printing units of both machines is attained, according to this invention, by using only one control frequency, which represents an ideal electric shaft rigidly constrained as to frequency and phase.

In practice this effect is obtained (see FIG. 3) by placing an electro-mechanical pulse generating transducer 20 in contact with the transmission roller 5 of the first machine, so as to obtain a pulse frequency $FA_1$ proportional to the speed of belt 3 of the lower machine 1. This pulse frequency signal $FA_1$ is simultaneously applied to two step-by-step signal amplifier converters 21 and 22. These converters convert pulses in the frequency signal $FA_1$ to amplify frequency signals having a power and form suitable for energizing step-by-step motors 23 and 25. Thus, converter 21 feeds step-by-step motor 23, which drives hydraulic motor 24 controlling the group of printing rollers 6 of machine 1, and converter 22 feeds step-by-step motor 25 driving, through hydraulic motor 26, the group of printing rollers 18 of machine 2. Converters 21 and 22 are commercially available from either Contraves Italiana S.p.A. or Siemens A. G.

As noted, the amplifier converters 21 and 22 have the task of amplifying and obtaining signals of suitable power and form as to make possible the controlling of the respective step-by-step motors 23 and 25. In this manner these motors are compelled to rotate rigidly constrained as to phase and frequency, since they are both driven solely by the same piloting signal $FA_1$. Contacts 27 and 28 are inserted in the electrical circuits of the signal amplifier converters 21 and 22. By actuating these contacts it is possible to operate both machines simultaneously or only the upper machine 2 for the normal printing.

Figure 3:
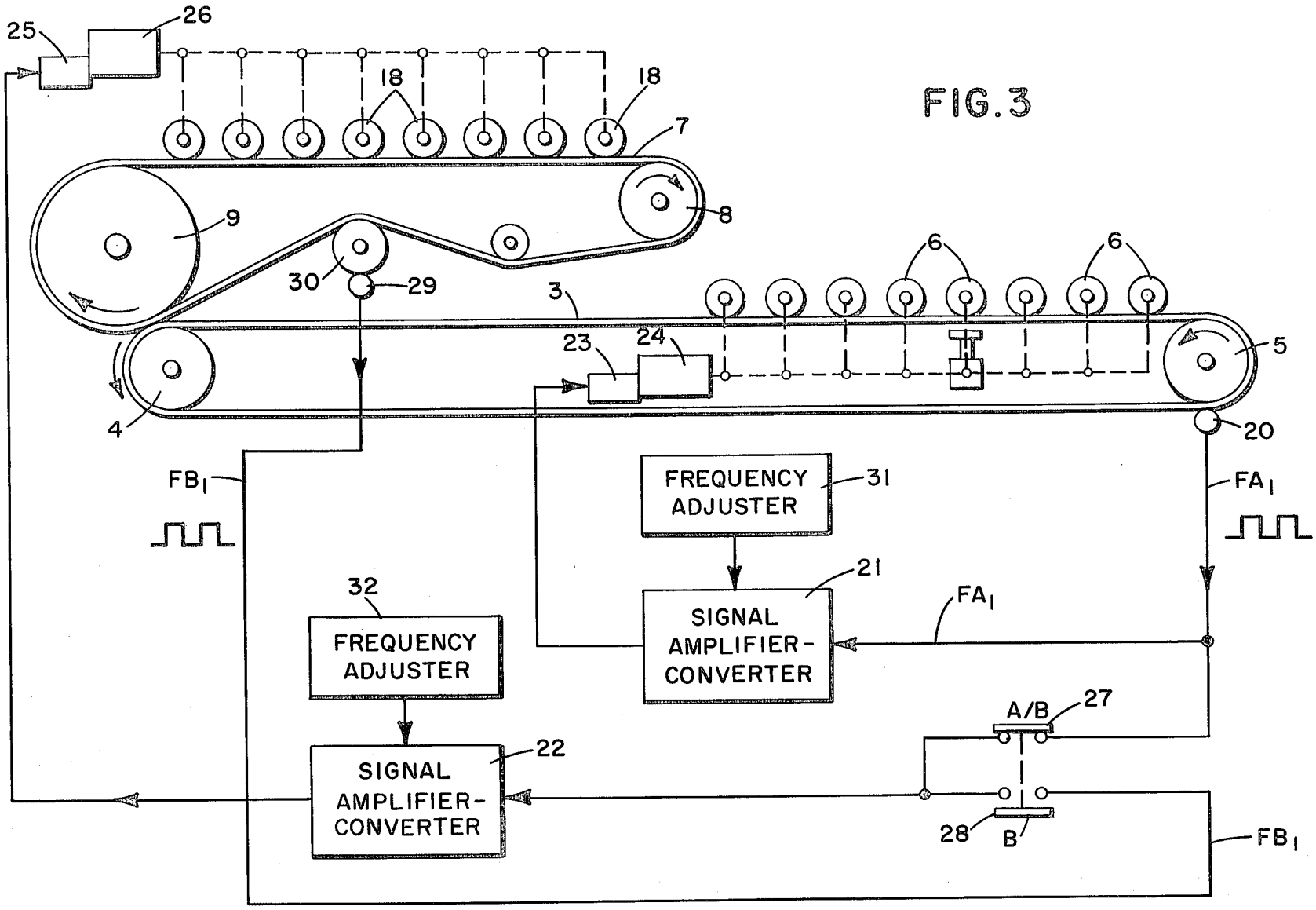
FIG. 3 represents the diagram of the various electromechanical and electronic devices for synchronizing the speed and phase of the cylindrical printing screens of one machine with those of the other machine; and finally

In fact, when contact 27 is closed and contact 28 is open as shown in FIG. 3, frequency $FA_1$ is sent to both amplifier converters 21 and 22 and then to machines 1 and 2. When contact 27 is open and contact 28 is closed, a frequency signal $FB_1$, picked up by a transducer 29 applied to a transmission roller 30 of the upper machine 2, is sent to translator 22 of machine 2. Machine 1 remains excluded, so that the other (upper) machine can be utilized for normal printing by feeding fabric 13' (FIG. 1) directly to belt 7 onto which it is glued by means of glue applicator or dispenser 12'.

Devices 31 and 32 are known devices for slightly altering the frequency of an applied signal. For example, they allow for the addition or deletion of a single pulse in a pulse stream containing a large number of pulses e.g. 10,000. These devices are associated with both amplifier converters 21 and 22 and enable one, by manual control, to equalize the speed of the printing units in relation to the speed of the corresponding belt. In case of operation with coupled machines, devices 31 and 32 (microdriver) are both positioned in exactly the same manner, in order not to modify the outgoing signals of the power translators which are sent to the electrohydraulic motors 23–24 and 25–26; in fact, said outgoing signals from the power translators must be strictly in phase with each other and equal to inlet signal $FA_1$.

Figure 4:
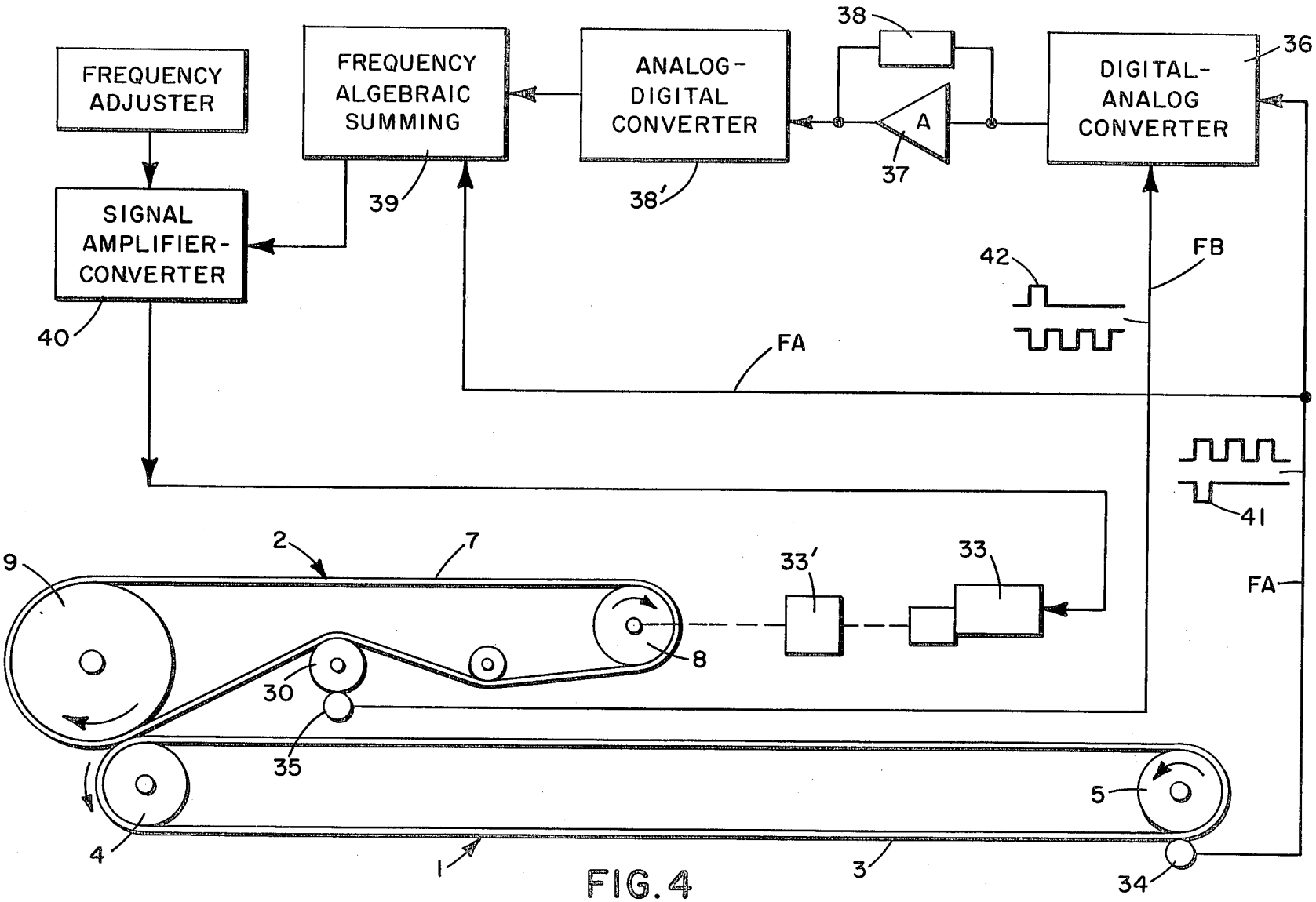
FIG. 4 represents schematically a synchronization diagram of the speeds of the belts of both machines.

The speeds of belts 3 and 7 are synchronized by an electronic circuit shown schematically in FIG. 4. The devices there utilized comprise an electrohydraulic motor 33 with relevant reduction gear 33' for the control of roller 8 of the upper machine 2, a digital transducer 34 mounted on transmission roller 5 of the lower machine 1, a similar transducer 35 mounted on carried roller 30 of the upper machine 2, and an electronic circuit comparing frequencies FA and FB emitted by transducers 34 and 35 respectively.

By this arrangement, a number of revolutions strictly proportional to a piloting signal FA coming from transducer 34 mounted on roller 5 of the first machine is transmitted to roller 8 of machine 2. In this manner a rigid correlation between the movements of the two belts of the machines is obtained.

Because in the long run variations in the coefficients of friction between rollers and relevant belts, as well as in the stretching force of the belts as a consequence of unavoidable elongations of the latter will occur, it is necessary to compensate the slippages between belts and relevant rollers. For this purpose (see FIG. 4) use is made of a closed-ring regulating circuit consisting of a digital-analogue converter 36, which compares frequencies FA and FB with each other (as functions of the speeds of both belts) and emits a voltage difference signal which is amplified in an amplifier 37 equipped with a converter 38 which receives an incoming voltage analog signal and converts it to a frequency signal. The outgoing signal of amplifier 37 is reconverted into a frequency signal by a analog-digital converter 38. The outgoing signal, which is an error-signal, is sent to a frequency algebraic summing device 39 which emits a signal that, after having been amplified by a amplifier converter 40 identical to amplifier converters 21 and 22, represents the piloting signal for the electrohydraulic motor 33 controlling the upper machine 2.

In order to secure the linking up in phase of the forward displacements of the belts, each of the transducers 34 and 35 emits a "zero"-signal (indicated by 41 and 42 in FIG. 4) at every revolution of the wheels mounted on the transducers.

The synchronizing devices which synchronize both the angular speeds of the printing rollers and the displacement speeds of the belts of the two machines coupled with each other, together with the particular roller 9 which transfers the fabric, enable one in practice to obtain a perfectly specular print of a same pattern and/or of the same color on both faces of the fabric.

The feeding devices, transducer devices, etc., referred to above are per se conventional devices well known in the art.

What is claimed is:

1. A rotary cylindrical-screen printing apparatus for specularly printing equal patterns or colors onto the opposite faces of a fabric comprising: first and second rotary cylindrical screen printing machines of the type having a carrier belt and transmission roller for supporting and moving fabric with respect to a printing roller, said machines being connected with each other, said first machine being supported above said second machine;

means for feeding said fabric to said second machine, whereby printing on one face occurs;

means for feeding printed fabric exiting said second machine to said first machine whereby the opposite face of the fabric is printed;

said upper machine transmission roller having a diameter equal to at least twice the diameter of the transmission roller of the underlying machine;

means for synchronizing the speeds of the printing rollers of the two machines, including a transducer means interlocked to the speed of the belt of one machine, having an outgoing frequency signal sent to first and second electrohydraulic motors for controlling the printing rollers of each machine; and means for synchronizing the speed and phase of the two belts by interlocking the speed of the belt of one machine with the speed of the other belt comprising digital-analog converter means for effecting a comparison between the speeds of the two belts so as to emit an outgoing signal for the correction of speed and synchronization; and means for controlling the speed of each belt in response to said outgoing signal whereby said belts are synchronized.

2. A printing apparatus according to claim 1, in which the diameter of said transmission roller associated with said first machine belt is preferably greater than twice the diameter of the transmission roller associated with said second machine.

3. A printing apparatus according to claim 1, in which said means for synchronizing the speed of the printing rollers of the two machines comprises a transducer communicating with the belt of one machine having an outgoing frequency signal applied to two power translators which emit two signals having substantially the same frequency and phase for driving the electrohydraulic control motors of the two machines, whereby said motors rotate at the same frequency and phase.

4. A printing apparatus according to claim 1, in which manually operated switch contacts are inserted in the feeding circuit of said power translators for disconnecting the operation of said first machine from said second machine and to cause said second machine rollers to operate in response to a signal derived from the belt movement of said second machine, said signal being amplified by means of a corresponding power translator and applied to the electrohydraulic motor of said machine.

5. A printing apparatus according to claim 1, whereby synchronization of the two belts is carried out by a circuit comprising two electromechanical transducers, one of which is applied to one belt and the other to the other belt, said transducers providing frequency signals proportional to the speeds of the two belts; digital-analogue converter means for effecting the comparison between said two signals, an operative amplifier which amplifies a voltage signal emitted by said converter means, a second digital-analogue converter means for converting said amplified signal into a frequency signal; and a frequency algebraic summing means for summing the frequency signal derived from one of said transducers and the signal emitted by said second digital analog converter, the output signal thereof being sent to said means for controlling the speed of said belt associated with said one transducer.

6. A printing apparatus according to claim 5, wherein transducers associated with each of the two belts communicate with said belts via an associated wheel which rotates in response to movement of a belt, said transducers providing a zero signal and precisely prefixed frequency pulses at every revolution of a wheel of the transducers, said zero signals indicating the relative position of each of said belts.

* * * * *